US008453882B2

(12) United States Patent
Johnson

(10) Patent No.: US 8,453,882 B2
(45) Date of Patent: Jun. 4, 2013

(54) RAPID COOLING APPARATUS AND METHOD FOR DISPENSED BEVERAGES

(76) Inventor: Gregory A. Johnson, Plymouth, MI (US)

( * ) Notice: Subject to any disclaimer, the term of this patent is extended or adjusted under 35 U.S.C. 154(b) by 483 days.

(21) Appl. No.: 12/774,027

(22) Filed: May 5, 2010

(65) Prior Publication Data

US 2010/0282777 A1 Nov. 11, 2010

Related U.S. Application Data

(60) Provisional application No. 61/215,403, filed on May 5, 2009.

(51) Int. Cl.
*B67D 7/80* (2010.01)

(52) U.S. Cl.
USPC ..... 222/146.6; 222/183; 222/399; 62/138; 62/457.2

(58) Field of Classification Search
USPC ..... 222/400.7, 146.6, 399, 183; 62/457.2, 62/178, 138, 201
See application file for complete search history.

(56) References Cited

U.S. PATENT DOCUMENTS 3,865,276 A 2/1975 Thompson
4,225,059 A 9/1980 Kappos
4,437,319 A * 3/1984 Iannelli ..... 62/138
5,129,552 A * 7/1992 Painchaud et al. ..... 222/146.6
5,377,878 A * 1/1995 Rainey et al. ..... 222/146.6
5,584,184 A 12/1996 Inaguchi et al.
5,915,602 A * 6/1999 Nelson ..... 222/608
6,105,825 A * 8/2000 Gomi et al. ..... 222/146.6
6,481,238 B1 * 11/2002 Jennings et al. ..... 62/457.4
7,861,892 B1 * 1/2011 White et al. ..... 222/108
2007/0056296 A1 * 3/2007 Gagliano ..... 62/3.64
2007/0277547 A1 * 12/2007 Veeravagu et al. ..... 62/396
2008/0029543 A1 * 2/2008 Leufgen et al. ..... 222/146.6

* cited by examiner

*Primary Examiner* — Kevin P Shaver
*Assistant Examiner* — Christopher Bahr
(74) *Attorney, Agent, or Firm* — John R. Benefiel

(57) ABSTRACT

An apparatus for rapidly cooling beer flowing from a keg to a tap to be dispensed includes an insulated ice chest containing an open topped swirl pot in which is nested a cooling coil having an inlet connected to a keg and an outlet connected to a tap on a hollow upright structure fixed to the outside of an ice chest lid. A pump is connected to a stand pipe within the coil directing a flow of ice water under pressure to generally tangentially directed nozzles within the coil creating a swirl flow of ice water over the coil turns and overflowing back into the ice chest interior space holding ice to create a circulation therein maximizing the rate of cooling of the dispensed beer to minimize foaming when dispensed from the tap. A $CO_2$ tank is also held in the ice chest interior space, connected to the keg via fluid lines and simplified hook ups to the keg are located on the lid mounted hollow structure.

10 Claims, 4 Drawing Sheets

RAPID COOLING APPARATUS AND METHOD FOR DISPENSED BEVERAGES

CROSS REFERENCE TO RELATED APPLICATIONS

This application claims the benefit of U.S. provisional application No. 61/215,403 filed on May 5, 2009.

BACKGROUND OF THE INVENTION

This invention concerns cooling of tap dispensed beverages and particularly beer flowing from a keg.

Beer kegs are commonly used to serve beer at large gatherings, and involve pressurizing the keg with $CO_2$ gas and dispensing the beer from a tap connected to the keg. Cooling the beer is necessary for proper enjoyment but also to avoid excessive foaming of the bear at the tap which can interfere with dispensing of the liquid beer, resulting in wastage since the foam must be discarded.

Beer kegs are usually refrigerated and delivered cold, but, particularly in the summer time, the beer in the keg soon warms up enough that excessive foaming is a common problem.

It has heretofore been proposed to cool the beer just prior to reaching the tap by passing the same through a cooling coil surrounded by ice at a point close to the tap. See U.S. Pat. Nos. 5,584,184; 4,225,059 5,129,552; 3,865,276; 6,105,825 and 4,437,319 for examples of such a design.

However, cooling by ice is insufficient particularly in warm weather and over an extended period. The heat absorption by the ice is often poor as the melted ice water is warmed by the beer in regions immediately adjacent to the coils, substantially reducing the rate of cooling. The volume of ice is insufficient to maintain proper cooling over long periods such that refrigeration units have sometimes been employed, obviously substantially increasing the cost and complexity of the apparatus.

In an effort to provide adequate cooling, the kegs themselves are sometimes enclosed in a cooled enclosure, obviously greatly increasing the cost and bulkiness of the apparatus, and necessitating extra handling of the heavy kegs to load them into an enclosure.

Furthermore, such cooling apparatus has typically required extensive set up efforts to assemble and connect the various components, i.e. the $CO_2$ pressure tank and regulator, the tap and keg fluid line connections, etc.

It is an object of the present invention to provide an enhanced cooling apparatus capable of rapidly cooling dispensed beer to minimize the tendency for excessive foaming even in warm weather and over extended periods.

It is a further object to provide a compact self contained apparatus to simplify set up, and which has a large capacity for holding crushed ice, to keep the ice from melting over long periods, such that mechanical refrigeration is not required, nor is cooling of the keg itself.

SUMMARY OF THE INVENTION

These and other objects which will be understood by those skilled in the art upon a reading of the following specification are achieved by an apparatus including a large volume insulated ice chest having an interior space able to hold several bags of ice as well as a side-by-side small tank of $CO_2$ and a separate open topped swirl pot defining a chamber in which a cooling coil is nested having an inlet connected to the keg via an external line. The swirl chamber has a series of generally tangentially directed nozzles arranged within the coil projecting from an upright pipe, with pump connected thereto which draws in ice water from within the ice chest interior space and pumps it out of the nozzles to a series of jets create a swirling flow of ice water over the cooling coil turns.

The ice water jets fills and overflows the swirl chamber to also set up circulation within the ice water in the ice chest interior space. This enhanced cooling of the coil turns quickly cools beer flowing through the coil which is directed from a coil outlet to a tap mounted to an upright hollow structure fixed to the ice chest lid which provides to serving counter.

A regulator connected to the $CO_2$ tank and to the keg being tapped.

The insulated ice chest with the $CO_2$ tank and swirl pot can be readily moved as with a set of built in wheels and retractable handle incorporated into the insulated ice chest for convenient moving and set up at any desired location.

The rapid cooling of beer minimizes the development of foam even during warm weather and over long periods.

DETAILED DESCRIPTION

Figure 1:
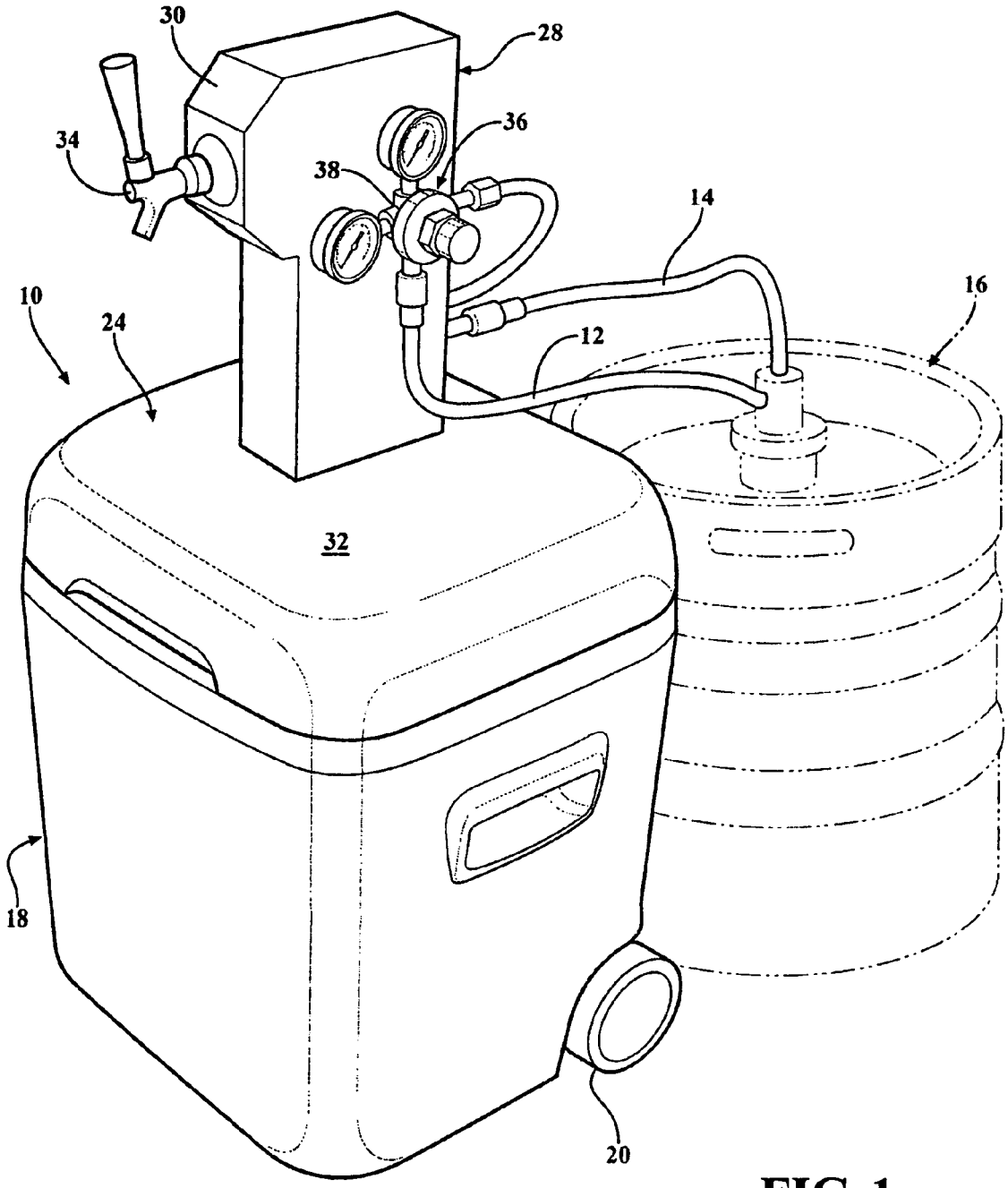
FIG. 1 is a pictorial exterior view of an apparatus according to the present invention with a keg shown in broken lines connected thereto.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, an apparatus 10 according to the present invention is shown having connecting fluid connections 12, 14 to and from a keg 16 containing a beverage (beer) of a type widely used for serving large numbers of people at weddings, picnics, sporting events, etc.

Figure 2:
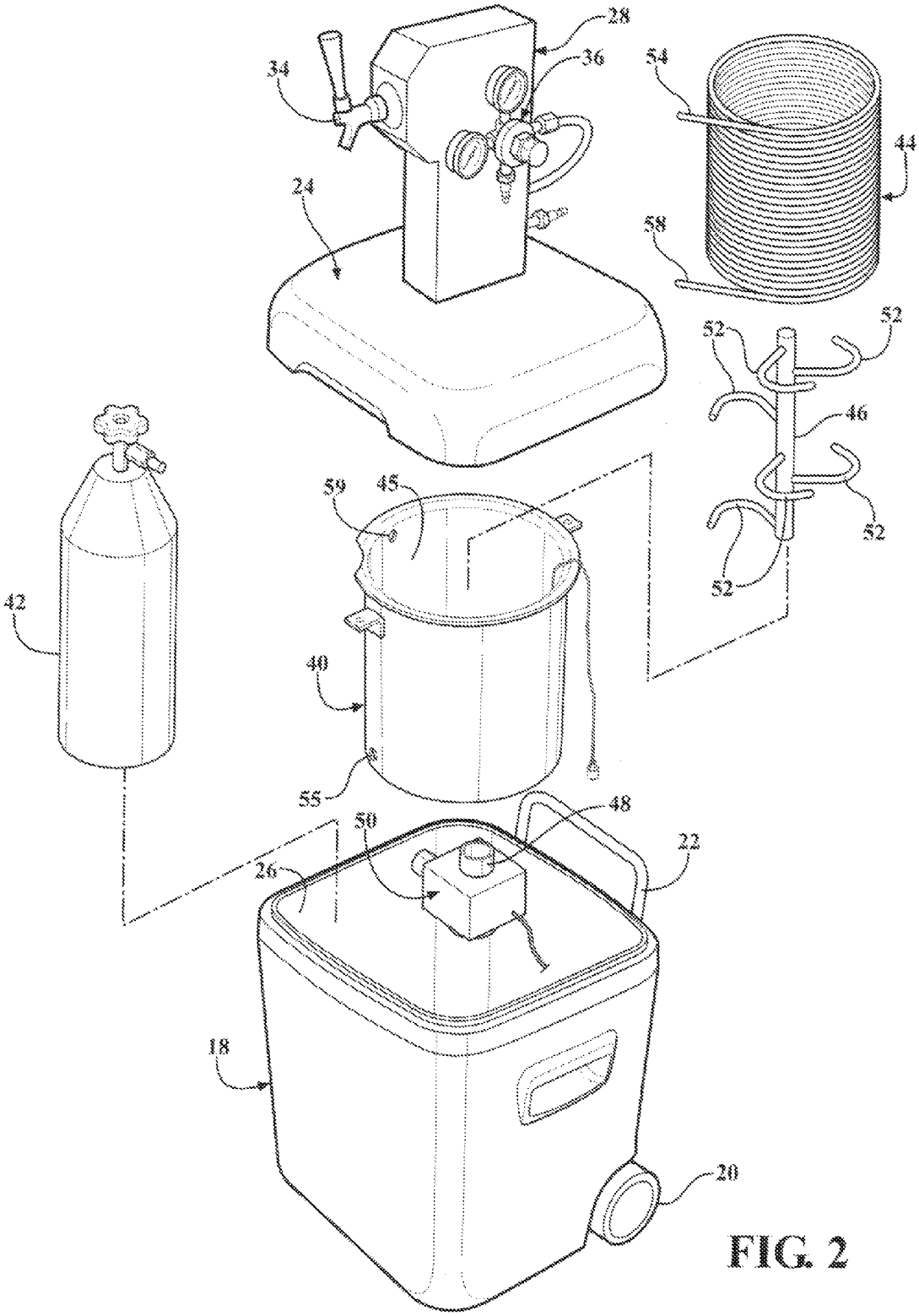
FIG. 2 is an exploded pictorial view of the components of the apparatus shown in FIG. 1.

The apparatus 10 includes a large capacity insulated ice chest preferably equipped with wheels 20 and a built in retractable handle 22 (FIG. 2) to be easily transportable.

A hinged lid 24 enables ready access to an interior space 26 and the outside surface also providing serving counter as described herein.

An upright hollow structure 28 is fixed to the lid 24 and receives the various lines from components housed within the interior space 26, described below.

A horizontally projecting upper portion 30 of the hollow structure mounts a tap 34 at height above the lid upper surface 32 beneath the tap 34 providing a convenient support for mugs, pitchers, etc., to be filled with beer.

A pressure regulator 36 allows adjustment of a gas typically $CO_2$ under pressure which is the keg interior to allow dispensing of the beer from the keg 16 in the well known manner.

A regulator 38 mounted to upright structure 28 enables adjustment of the pressure of the $CO_2$ and also allows a convenient connection to be made between the keg 16 and pressurized $CO_2$ tank 42 in the ice chest space 26 via the line 12.

A second line 14 receives a flow of beer from the keg 16, which is used to directed to the tap 34 via an interior line described below.

The ice chest interior space 26 also holds an open topped cylindrical swirl pot 40 preferably of stainless steel, sitting on one side of the tank 42 of compressed gas ($CO_2$). The swirl pot 40 defines a cylindrical swirl chamber 44 into which is nested a cooling coil 46, also preferably of stainless steel tubing.

A stand pipe 46 is mounted to extend upwardly within the coil 44 and swirl chamber 45, fixed to the outlet 48 of a circulation pump 50 mounted below the swirl pot 40.

The stand pipe 46 has a plurality of tubing nozzles 52 spaced axially up the stand pipe projected radially out but curved to be directed in a generally tangential direction with respect to the turns of the cooling coil 44.

An inlet 54 to the coil 44 passing out through hole 55 in the top of the swirl pot 40 is connected to line 14 via connector line 56, while the outlet 58 passing out through a hole 59 at the bottom of the swirl pot 40 is connected to the connection line 60 connected to the tap 34, both routed through an opening in the lid 24 up within the hollow upright structure 28.

The $CO_2$ tank 42 is connected to the regulator 36 via a connecting line 62. Pressure gauges A,B allow setting of the $CO_2$ pressure directed to the keg and the pressure in the $CO_2$ tank 42.

The pump 50 has an inlet 64 drawing in melt water from the bottom of ice chest space 26 in the ice chest 18, and has an electric cord 66 routed up into the structure 28 and out to be connectable to an electric outlet or extension cord (not shown).

Figure 3:
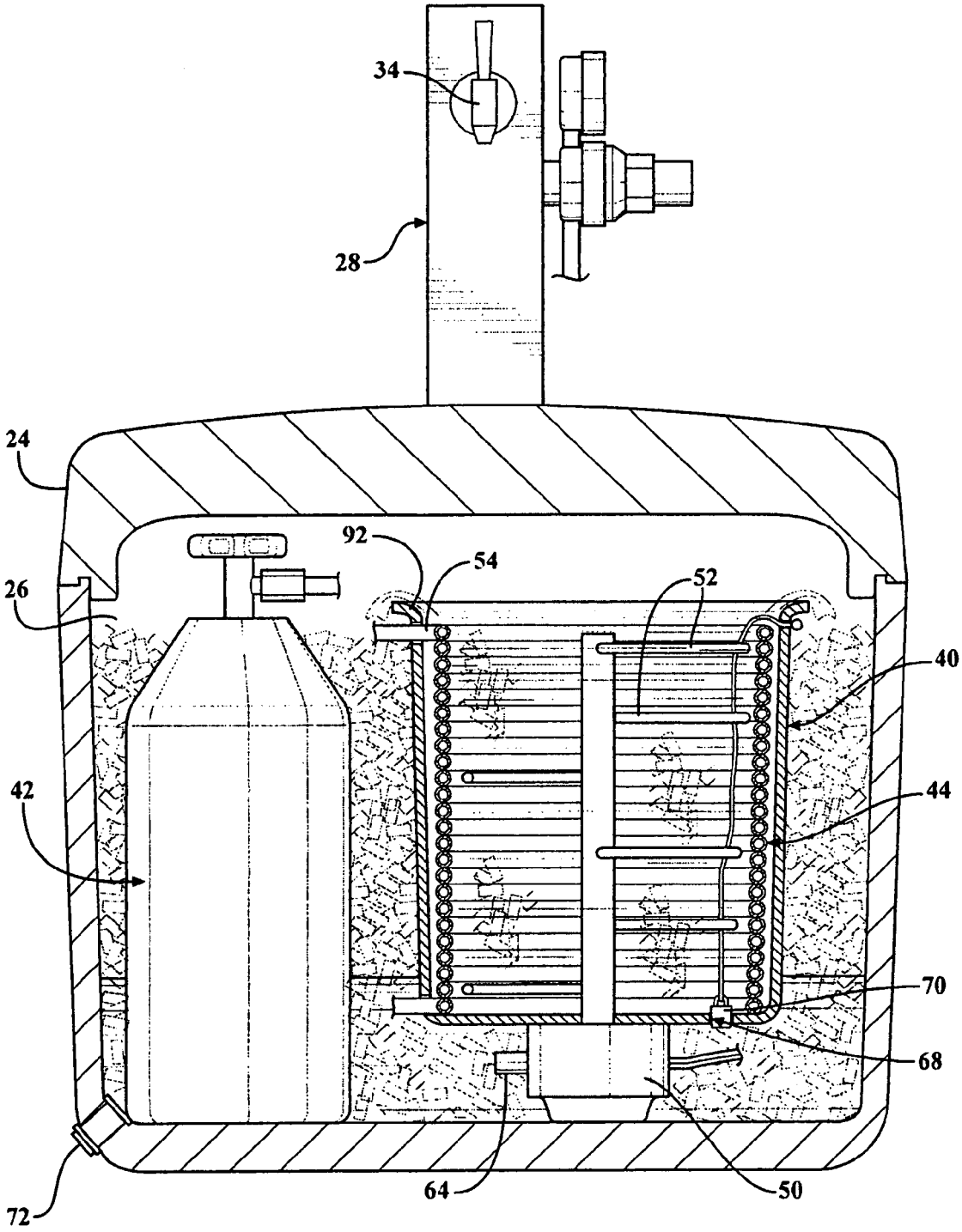
FIG. 3 is a sectional view of the apparatus shown in FIG. 1.
Figure 4:
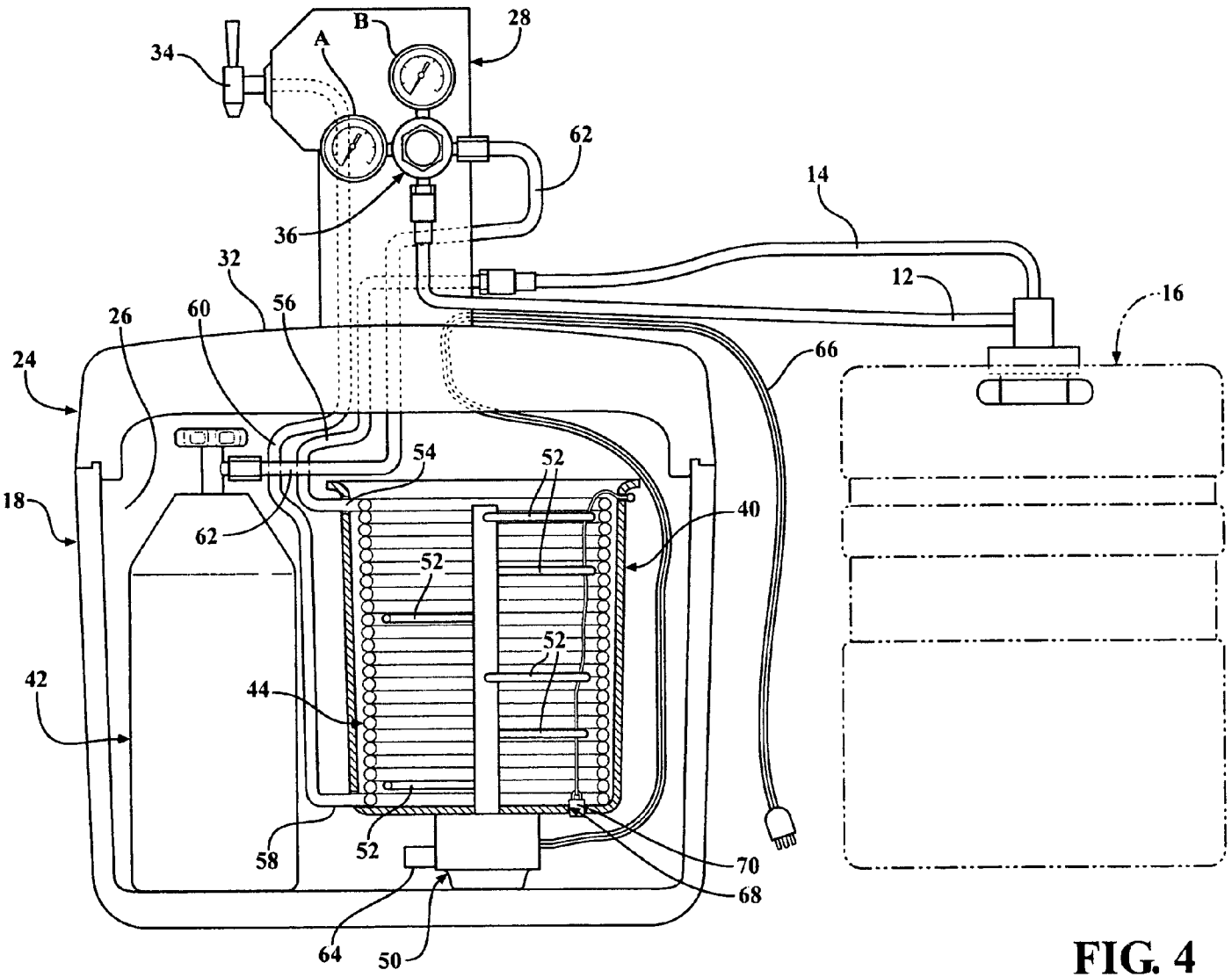
FIG. 4 is a diagrammatic view of the apparatus showing the various connections between the components thereof and the keg.

The swirl pot 40 has a bottom opening 68 normally plugged with a stopper 70 so that water sprayed out from nozzles 52 accumulates until overflow occurs via the rim 72 as indicated in FIG. 3. The ice chest space 26 including the swirl chamber 45 is initially filled with crushed ice and a volume of water about 1½ times the volume of the swirl chamber 45 to allow the pump 50 to begin circulating water.

The swirling flow occurs constantly so that the tubing turns of the coil 44 are constantly contacted with the ice water at 32° F., heat from the beer flow to the tap 34 being thereby absorbed to be rapidly cooled.

At the same time, the overflow from the swirl chamber 45 establishes some circulation of the melt water in the ice chest interior space 26 containing the ice.

This arrangement has been found to be very effective to rapidly cool the beer (or other beverage) just before reaching the tap 34 to minimize foaming.

The self-contained nature of the design allows quick set up with minimum number of fluid line hook ups.

Indeed, a business model is feasible in which a service provider can provide a complete set up to customers along with the keg 16 for maximum convenience to the customer.

The swirl chamber 45 can be drained into the ice chest interior space 26 by removing plug 70, which in turn can be conveniently drained by removal of plug 72 (FIG. 3) or opening a drain valve.

The invention claimed is:

1. An apparatus for rapid cooling of a beverage caused to flow from a beverage container to a dispenser tap, comprising:

an insulated wall ice chest having an openable lid and able to receive a volume of crushed ice in an interior space defined therein;

a generally open topped swirl pot in said interior space of said ice chest defining a cylindrical swirl chamber;

a concentric cooling coil of helical tubing turns nested within said swirl chamber;

a fluid connection between an inlet of said cooling coil and said beverage container;

a fluid connection between an outlet of said cooling coil and said dispenser tap;

a pump mounted within said ice chest interior space having an outlet connected to a stand pipe mounted to project up within said cooling coil and an inlet disposed to draw in melt water collected in the bottom of said ice chest interior space from the melting of crushed ice therein;

said stand pipe having a plurality of jet nozzles receiving ice melt water pumped by said pump and directing jet flows within said coil, said jet nozzles radially inclined to create a generally tangential swirling flow against adjacent tubing turns of said cooling coil, whereby a beverage circulated through said cooling coil is rapidly cooled prior to being dispensed from said tap by cooling of said cooling coil turns through which said dispensed beverage flows.

2. The apparatus according to claim 1 wherein said jet flows ice water fills said swirl chamber and overflows therefrom to reenter said interior space.

3. The apparatus according to claim 1 wherein beer is received from a keg and is dispensed from said tap.

4. The apparatus according to claim 3 further including a pressurized gas tank disposed within said ice chest interior space and a fluid connection extends from said tank to said keg via a regulator.

5. The apparatus according to claim 4 wherein said tap is mounted to an upright hollow structure on said ice chest lid and said fluid connection from said coil outlet tube extends up within said hollow structure to said tap.

6. The apparatus according to claim 5 wherein said fluid connection between said tank and said keg extends within said hollow structure and to a pressure regulator mounted on the exterior of said hollow structure.

7. The apparatus according to claim 1 wherein pump is mounted below said a bottom wall of said swirl pot.

8. A method of enhancing the cooling of a flow of beer to a tap through a cooling coil disposed in an ice chest containing crushed ice for cooling, comprising: nesting said cooling coil within a swirl chamber disposed in said ice chest; continuously pumping melted ice water collected in the bottom of said ice chest out through a plurality of jet nozzles within said cooling coil inclined so as to extend generally tangentially to turns of said cooling coil to create a tangential swirl flow against the inside of said coil turns to maximize cooling of beer circulated within said cooling coil prior to being dispensed from said tap.

9. The apparatus according to claim 1 wherein said plurality of jet nozzles are spaced axially up said standpipe.

10. The method according to claim 8 wherein said plurality of jet nozzles are spaced axially along the interior of said cooling coil to simultaneously direct substantially tangential jet flows at the inside of a plurality of turns of said cooling coil.

* * * * *